US005765580A

United States Patent [19]

Dassi

[11] Patent Number: 5,765,580

[45] Date of Patent: Jun. 16, 1998

[54] COMPLEMENTARY CLEANSER DEVICE FOR TOILET BOWLS

[75] Inventor: Francesco Dassi, Novara, Italy

[73] Assignee: Imetec S.p.A., Bergamo, Italy

[21] Appl. No.: 787,941

[22] Filed: Jan. 23, 1997

[30] Foreign Application Priority Data

Jan. 24, 1996 [IT] Italy ..... MI960054 U

[51] Int. Cl.[6] ..... B08B 3/02

[52] U.S. Cl. ..... 134/167 R; 134/160 R; 134/169 R; 134/198; 134/201; 239/373; 239/378; 222/323

[58] Field of Search ..... 134/169 C, 201, 134/196, 166 C, 166 R, 167 R, 167 C, 168 R, 168 C, 169 R, 198; 222/323, 401, 402.1, 402; 239/373, 378, 530

[56] References Cited

U.S. PATENT DOCUMENTS

| | | | |
|---|---|---|---|
| Re. 25,844 | 8/1965 | Zellner | 239/378 |
| 520,722 | 5/1894 | Blake | 222/401 |
| 578,902 | 3/1897 | Ruggles | 222/401 |
| 587,532 | 8/1897 | Morgan | 239/373 |
| 774,461 | 11/1904 | Wolf | 222/401 |
| 872,314 | 11/1907 | Wilson | 239/373 |
| 1,187,819 | 6/1916 | Daniels | 239/373 |
| 1,782,083 | 11/1930 | Wilcox | 222/401 |
| 1,987,649 | 1/1935 | Wertz | 134/168 R |
| 2,605,478 | 8/1952 | Lassiter | 134/168 R |
| 2,658,301 | 11/1953 | Merrill | 222/401 |
| 3,199,739 | 8/1965 | Corning et al. | |
| 4,183,105 | 1/1980 | Womack | 134/167 R |
| 4,192,464 | 3/1980 | Chow . | |
| 4,773,113 | 9/1988 | Russell | 134/168 C |
| 4,877,158 | 10/1989 | Kohler | 239/372 |
| 5,175,890 | 1/1993 | Ruth . | |
| 5,511,568 | 4/1996 | Bowman et al. | 134/166 C |

FOREIGN PATENT DOCUMENTS

| | | | |
|---|---|---|---|
| 3704970 | 2/1988 | Germany . | |
| 29505127 | 3/1995 | Germany . | |
| 186065 | 9/1922 | United Kingdom | 222/401 |
| 522885 | 6/1940 | United Kingdom | 222/401 |

*Primary Examiner*—Frankie L. Stinson
*Attorney, Agent, or Firm*—Diller, Ramik & Wight, PC

[57] ABSTRACT

The present invention relates to a suitable device for completing toilet bowls cleansing, after that water discharged from water hopper has drained, by launching a jet of pressurized water, which device displays the special feature of consisting of a support means carrying a container to be filled/refilled with water, the necessary apparatus form pressurizing said water, and a water launching nozzle body.

The support means carrying the above said elements can be suitably statically positioned (fastened), whereas, although it remains functionally connected with said support means, the water launching nozzle body can be moved away from it and, while being hand-carried by the user, can be freely oriented by her/him nearby said support means.

32 Claims, 5 Drawing Sheets

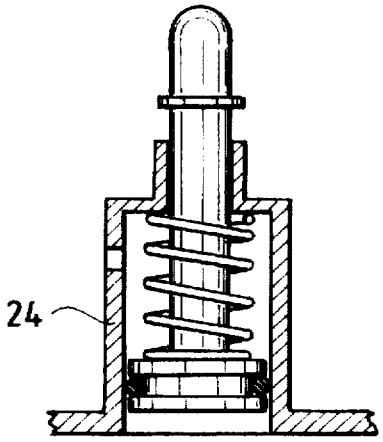
Fig.4B
Fig.4E
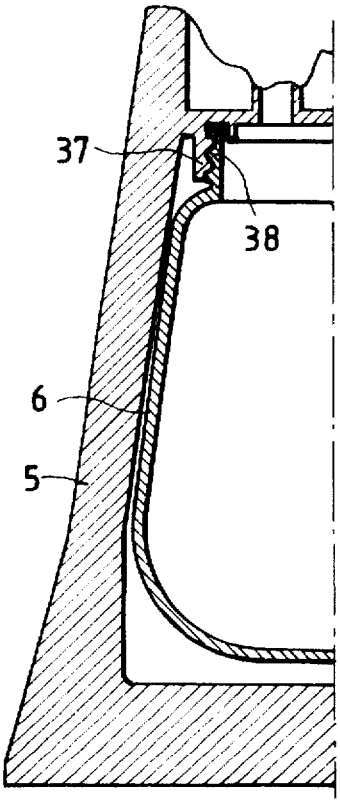
Fig.4F
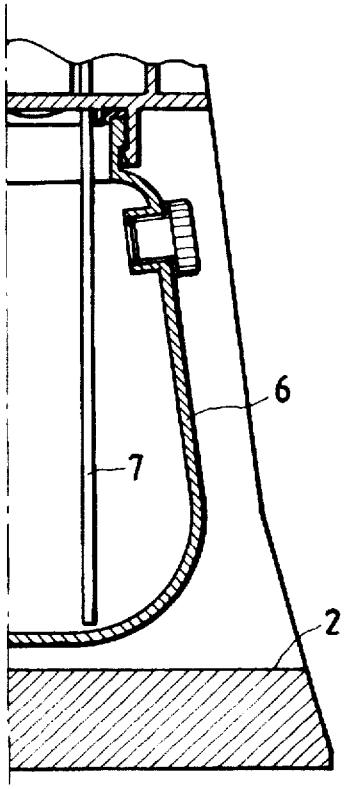

COMPLEMENTARY CLEANSER DEVICE FOR TOILET BOWLS

BACKGROUND OF THE INVENTION

The present invention relates to a suitable device for completing the cleansing of toilet bowls after the draining of water stream discharged from the water hopper, by launching a jet of pressurized water.

It is known that toilet bowls are equipped with a washing out system suitable for changing water at syphon level and in particular for washing out the products of physiological evacuation. Such a cleansing action is performed by the classic water flushing stream which, either from a hopper, or from the outlet of a valve connecting with water distribution system, flows more or less violently from the high side and along the inner walls, towards the bottom of toilet bowls.

However, not always this washing out action is enough in order to remove all traces of evacuation residues, in particular in those systems in which for cleansing the toilet bowl only that water amount is available which is contained inside the hopper.

It often happens that even after a number of successive flushings, or continuous water stream releases succeed in obtaining that cleanliness which is so desired owing to aesthetical and hygienic reasons. In fact, besides every toilet bowl, the inevitable presence can be observed of the container for a cleansing brush. This surely is an accessory which is as indispensable as unpleasant to use, impossible to be thoroughly cleaned, unsightly (not to say disgusting) and undoubtedly insanitary, because it can never be kept in a perfectly clean condition. Paradoxically, it should always be disposed off after each use, as it happens for toilet paper, rather than being used again.

SUMMARY OF THE INVENTION

The task of the present invention is precisely of ridding of the previously complained drawbacks, by providing a complementary cleansing device for toilet bowls which, in a simple, hygienic and effective way, ultimately washes out any sticky evacuation residues which, notwithstanding the water flushes released by toilet bowl washing facility, can have remained adherent to its walls.

Within the scope of the above recited task, a particular purpose of the invention is of providing a complementary cleansing device for toilet bowls which does not absolutely come into contact with the dirty residues to be removed but which operates through a pressurized water jet acting as an intermediate element between dirt to be removed and the user, which water jet is suitably calibrated in order not to generate bounce sprays, and can be oriented as desired.

Another purpose of the present invention is also of providing a complementary cleansing device for toilet bowls which retains its perfectly hygienic conditions during and after use, and consequently can be stored in an absolutely clean and immaculate state.

Not least purpose of the present invention is also of providing a complementary cleansing device for toilet bowls which can be easily and effectively used by all users of toilet bowls irrespective of age, i.e., which will guarantee, in particular when used by children, that a perfect toilet bowl cleansing will be obtained, rather that allowing dirty residues to spread all around, as it sometimes happens when, for the purpose of cleansing the bowl, children use the classic brush.

The above recited task, as well as the above mentioned purposes and still other purposes which will become clear from the following disclosure, are achieved by a complementary cleansing device for toilet bowls which is particularly suitable for performing the end cleansing of toilet bowls after that water discharged from the hopper has flown off, characterized in that it comprises a suitable support for carrying:

- a tank which can be filled/refilled with water, and the necessary means for securing said tank to be supported under tightly sealed conditions;
- the necessary equipment for pressurizing water and the valves system for keeping pressure inside the water tank controlled at its useful value;
- a water launching nozzle body equipped with a tubular, extensible element for connecting it with the tank, and suitable for being removably stored on a purposely provided seat on the support means.

The support means is constituted by a structural assembly suitable for housing the apparatus for pressurizing water and the relevant control/regulation devices, the tank to be filled/refilled with water with the suitable hooking elements and, functionally resting on it, the water launching nozzle body.

The tank to be filled/refilled with water can be fixedly fastened onto the support means or, suitably, it can be removably fastened onto it.

The removable tank, suitable for being hooked onto the support means under tightly sealed conditions, consists of a container structure provided with a handle, is open at its top, and its outer bottom portion has such a shape as to get coupled with the support means with no possibility of performing axial revolution movements.

The fixedly fastened tank consists of a container structure provided with a filling/refilling mouth and a tightly sealing system.

The suitable equipment for increasing water pressure up to the useful pressure value, can be suitably constituted by an air pump manually actuated by means of a lever, or an electrical motor driven pump fed with power from the mains, or by accumulators.

Suitable valve devices are designed to keep water pressure at its useful pressure value, while controlling it to remain within safety values. In electrical motor driven models, such devices also control the electrical motor operating times/periods, as necessary in order to keep pressure constant.

The water launching nozzle body, while is connected to the tank (in its turn fastened onto the support means) through a flexible, extensible hose means, can be taken up and hand carried by the user, who can suitably orient it, and is equipped with the necessary control device for controlling the water jet launching/stopping, and a water jet regulating nozzle.

The so conceived device can be installed at will nearby the toilet bowl, practically instead of the classic brush container. The "sitting" time on toilet bowl is largely enough in order to pressurize water contained inside the tank either manually by the user, by means of a plurality of actuation movements of the lever, or by air pumping by the electrical motor driven pump, consequently it will be ready to allow the user to perform the complementary bowl cleansing action, by means of the water jets it generates, should the user regard it as useful.

Further characteristics, features and advantages will be clearer from the following disclosure of a preferred, non-exclusive embodiment of a complementary cleansing device for toilet bowls, illustrated for exemplifying, non-limitative purposes, with the aid of the accompanying drawings, in which

BRIEF DESCRIPTION OF THE DRAWINGS

In FIG. 4B a sectional view is shown of the useful pressure control valve which, in the electrical motor driven embodiments of the present device also controls the automatic electrical motor stopping/starting up;

In FIG. 4E a first embodiment is shown of the fixed tank with its loading mouth being engaged by the tightly sealing system.

In FIG. 4F a second embodiment is shown of the fixed tank with its loading mouth being engaged by the tightly sealing system.

DESCRIPTION OF THE PREFERRED EMBODIMENTS

Figure 1:
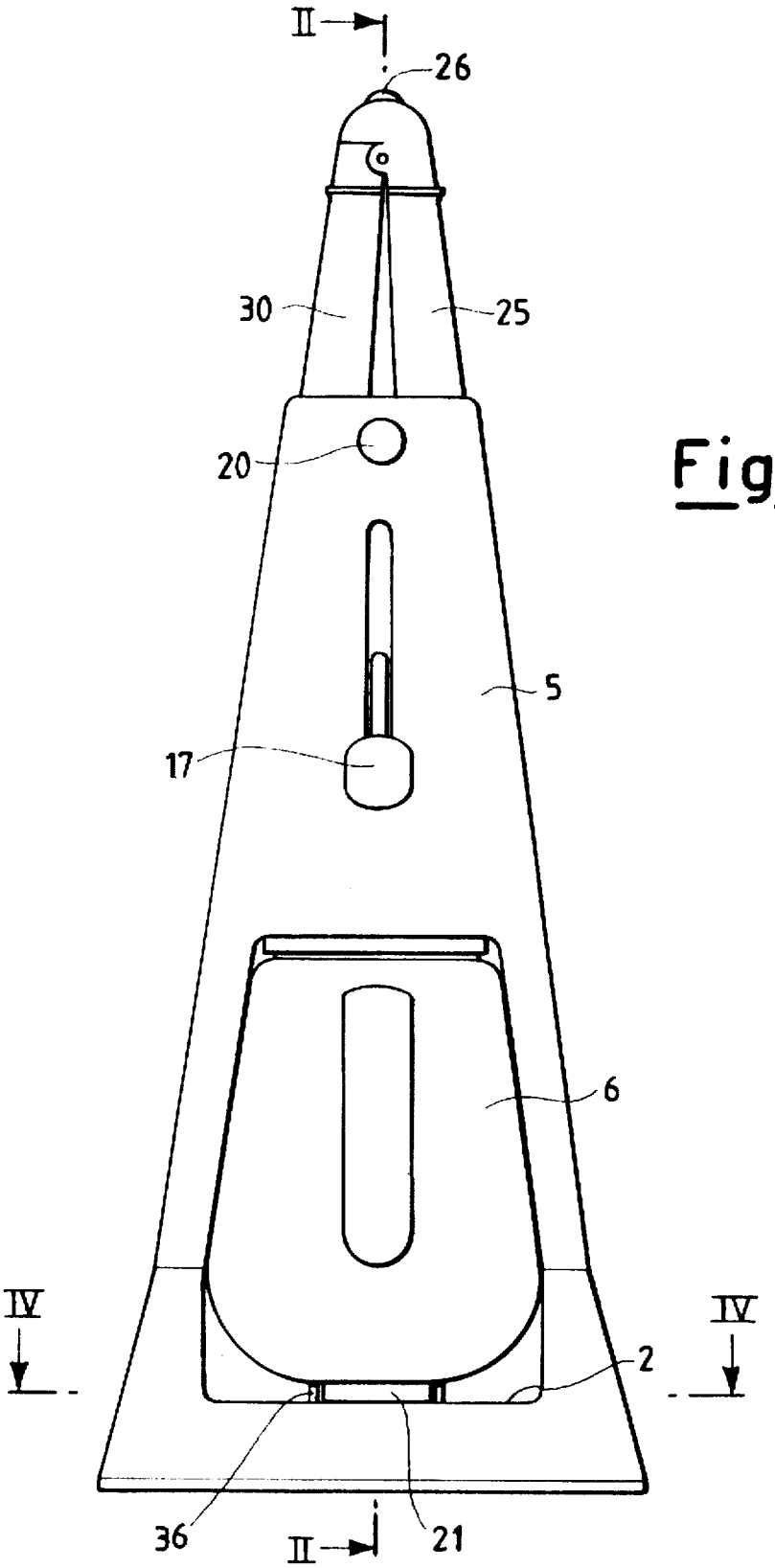
FIG. 1 shows a frontal view of the complementary cleansing device for toilet bowls complete with water container and water launching nozzle body, according to the present invention.

Referring to the above mentioned figures, in FIG. 1 a front view is displayed of the is complementary cleansing device for toilet bowls which comprises a hollow structure (5*) with a shape which preferably, but not necessarily, is frusto-conical and having in its bottom portion a chamber suitable for housing the tank (6*), and, in its central portion , the pressurizing lever (17*), in the case of the hand-operated embodiment; or the switch (20*) in the case of the electrical motor driven embodiment; and, at its top, under functionally resting conditions, the water jet launching body (25*) hinged with the half-body (30*), with, above both of them, the nozzle means (26*).

Figure 2:
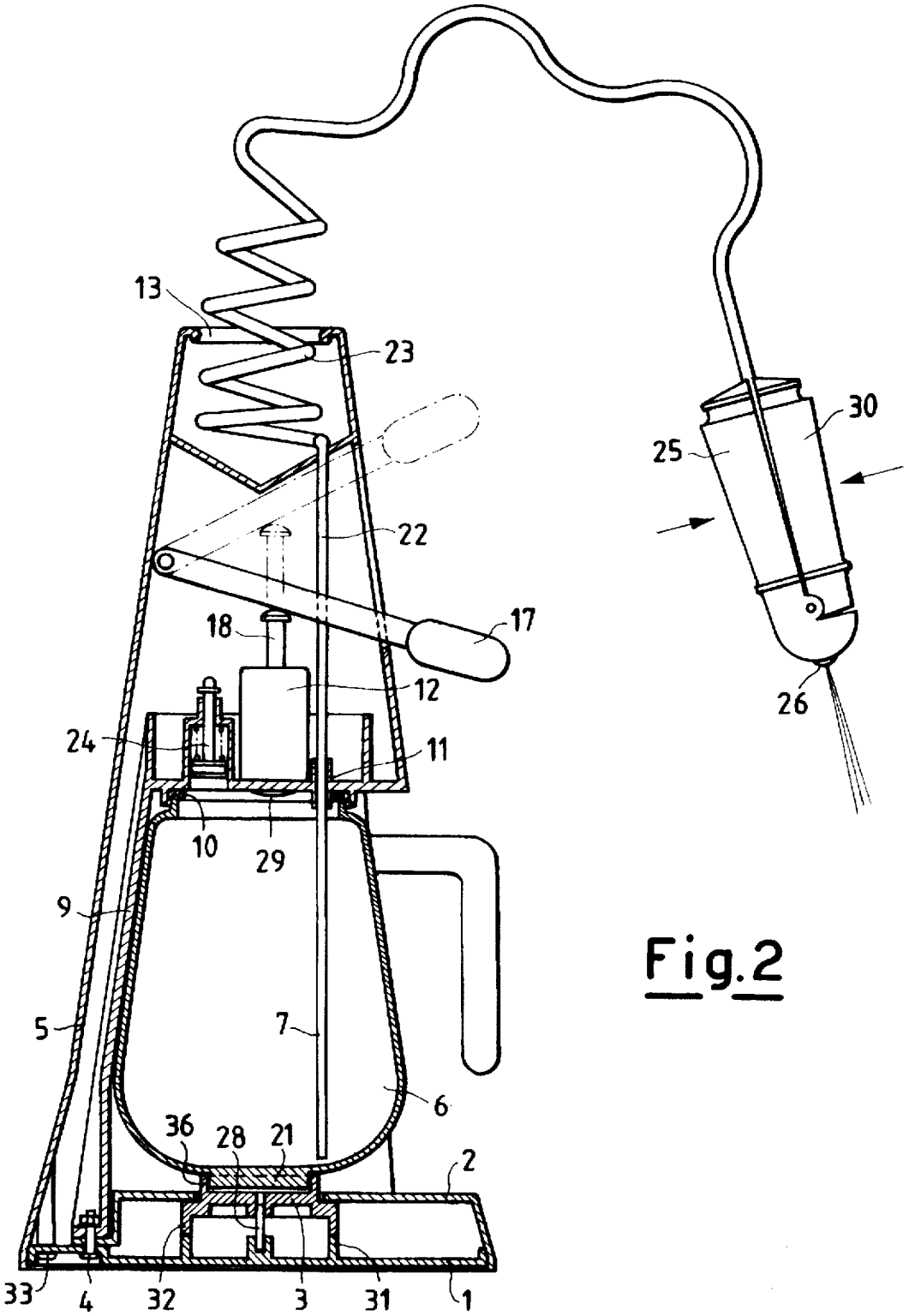
FIG. 2 shows a sectional view according to section line II—II of FIG. 1, of the hand-operated embodiment of the complementary cleansing device for toilet bowls with the removable water tank being hooked inside its seat in a tightly sealed condition and the water launching nozzle body being moved away from its resting seat and pressed in order to launch pressurized water jets.

In FIG. 2, which shows a sectional view made according to the section line II and II, the hand-operated embodiment of the device is shown in which one can see the base (1*), from which the central pin (28*) protrudes and, diametrically around it, the cam crown (31*) of the base (1*), functionally engaged with the cam crown (32*) of the plate (3*). Said plate (3*) can be seen in its high position, carried by the cams (31*) and (32*) and, resting above it, the removable tank (6*) can be seen which is kept pressed with its filling/refilling opening, against the tightly sealing gasket (10*) provided on the top inner portion of the structure (9*). The screw (4*) is one from the plurality of screws which keep the base (1*) fastened to the inner structure (9*), constraining by interference the table (2*). In (33*) a screw is shown from the plurality of screws which keep the base (1*) fastened to the outer structure (5*). On the top inner portion of the structure (9*) furthermore visible are the fitting (11*) which puts the dipleg (7*) into communication with the tubular duct (22*), the non-return valve (29*) of the hand-operated air pump (12*) and the pressure regulation valve (24*).

Above the inner structure (9*) the hand-operated air pump (12*) can be seen, which is engaged by the lever (17*) acting on the piston stem (18*).

In (22*) the tubular duct can be seen which allows pressurized water to reach the extensible hose coil. (23*) which, in its turn, leads to the opening/closure valve (14*) provided inside the water jet launching body (25*) and (30*).

The outer structure (5*) is only displayed as regards its task of functional aesthetical shell with its collar (13*) of the hose coil (23*) housing chamber, and not performing its task of acting as a support and elastic retention means for the water jet launching body (25*) and (30*) which, in this FIG. 2, is shown in its use position; the arrows indicate the movement performed by the half-bodies (30*) and (35*) when they are pressed by the user to move towards each other, with this movement resulting in water to be released from nozzle means (26*).

Figure 3A:
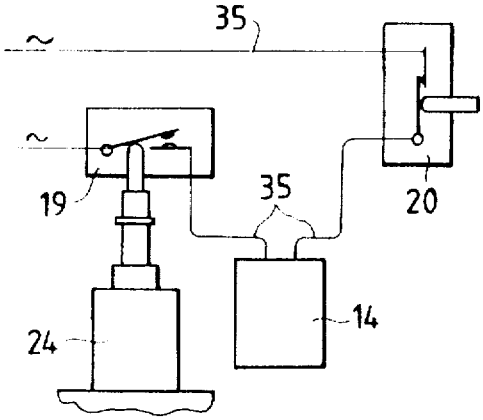
In FIG. 3A a simplified view is shown of the useful pressure control valve, the motor driven pump and the electrical system for automatic stopping/starting up.
Figure 3:
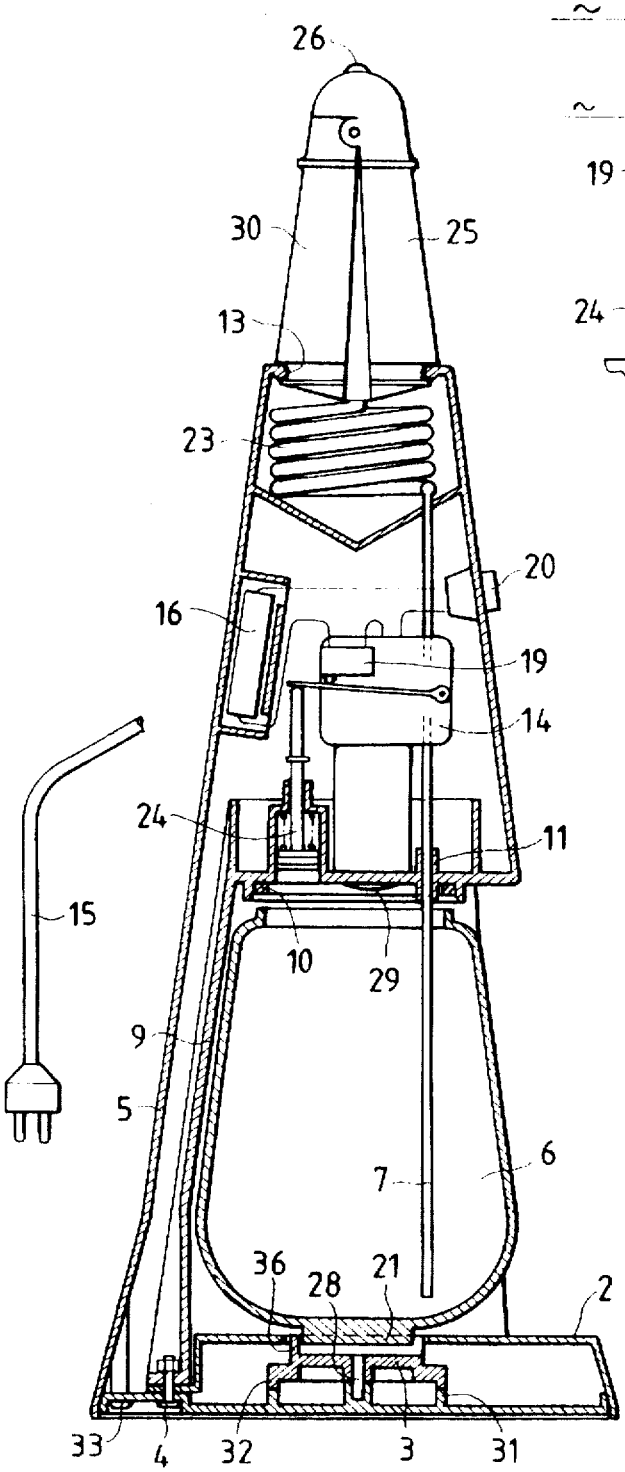
FIG. 3 shows a sectional view according to section line II—II of FIG. 1, of the electrical motor driven embodiment of the complementary cleansing device for toilet bowls.

In FIG. 3 a sectional view according to line II—II of FIG. 1 is displayed of the electrical motor driven embodiment of the complementary cleansing device for toilet bowls which is additionally shown in its situation in which the removable tank (6*) is ready to be extracted from its housing chamber, in order to be refilled with water by the user.

In that Figure, said tank (6*) is shown resting on the plate (3*), with its loading mouth being moved away from the tightly sealing gasket (10*) as a consequence of the fact that the cams (31*) and (32*), owing to the revolutionary movement performed in order to disengage the tank, have returned down to rest against their respective profiles, thus causing the tank to move downwards. Above the inner structure (9*) the electrical motor driven pump (14*) can be seen which, according to manufacturer's willing, can either be connected with the mains by means of a power feed cable (15*), or by means of accumulators (16*) through the relevant electrical system (35*), functionally controlled by the switch (20*), the microswitch (19*) and the stem of the valve (24*) provided for keeping active the motion cycle. In the top portion of the external structure (5*), the turns (23*) of the hose coil can be observed housed inside the hose coil housing chamber ending with the collar (13*) which keeps elastically constrained the elements (25*) and (30*) of the water jet launching body, kept expended by the spring (27*) of the valve (34*) housed between them.

In the detail of FIG. 3C, the electrical system is schematically represented which is provided in order to keep the inner pressure inside the water tank at its useful pressure value and to control the motion cycle stopping/starting up: (20*) is the starting up/stopping switch in its "active" position, (24*) is the pressure control valve which, when the useful pressure value is reached, by acting with its own stem on the microswitch (19*) stops the motion. Obviously, a pressure decrease will cause said stem to move downwards, with the motion cycle being restarted, and so forth.

Figure 4A:
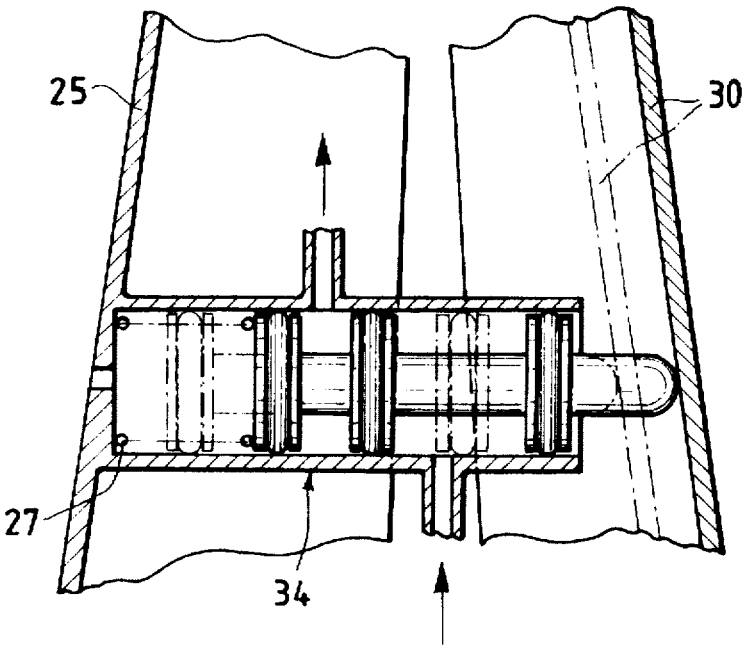
In FIG. 4A the closing/opening valve is displayed which controls the water flow to the external water jet launching nozzle, installed inside the elements of the water launching nozzle body and namely, in two different operating positions.

In FIG. 4A a detail sectional view is shown of the water jets opening/closing valve (34*), with the distribution piston being displayed sectioned along its middle axis, in order to display the "opening" situation when, by being moved inwards by the half-body (30*), said distribution piston compresses the spring (27*), and the "closing" situation when, by being urged to move outwards from said spring (27*), said distribution piston causes the elements (30*) and (25*) to move outwards until they reach their stroke limit.

In FIG. 4B a partial sectional view is shown of the valve (24*) which controls the useful pressure value, the electrical motor movement cycle, and so forth.

Figure 4C:
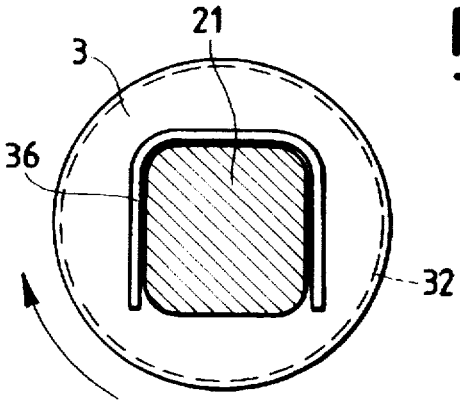
FIG. 4C shows a partial sectional view of the mutual revolution-movements-preventing coupling between the removable tank and the plate.

In FIG. 4C, a partial sectional view according to line IV—IV of FIG. 1, is shown of a portion of the plate (3*) with the element (36*) of said plate being in position of axial-revolution-movement preventing engagement with the element (21*) of the tank (6*).

Figure 4D:
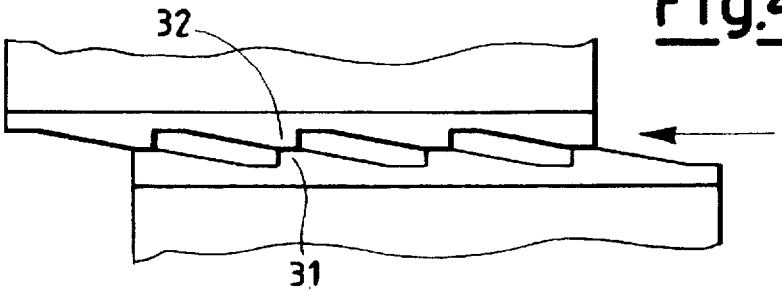
FIG. 4D shows a partial sectional view of the linear development of the circumferences of the cam crowns of the base and of the plate.

In FIG. 4D, the linear development is shown of the circumferences of the cams (31*) and (32*) in position of maximal axial thrust.

In FIG. 4E a partial sectional view is shown of the fixed tank displayed as being functionally connected under pressure against the tightly sealing gasket (10*) by means of the screw threaded collar (37*), with its filling/refilling mouth being tightly sealed by the element (38*).

In FIG. 4F, a view is shown of the tank fastening as obtained by means of a bayonet coupling.

The tightly sealing element shown is used for both closure systems proposed.

The above disclosed invention is constituted by the whole of disclosed elements. However, as we remarked in the disclosure, while always falling within the scope of the inventive concept and finally producing the aimed at effects, owing to reasons of cheapness or market demand, different embodiments of some of the disclosed elements may be envisaged, e.g.:

According to a particular embodiment, the removable tank can be hooked in a tightly sealed condition to the carrier support. Said tank consists of a container structure provided with a handle, is opened at its top side and externally ends with its bottom portion with a suitable shape for getting coupled with an axial-rotational-movement preventing constraint with a mating shape arising from a plate provided on the bottom of the housing chamber provided inside the body of the support means.

The centrally hinged plate rests with a cam crown it is provided with, on a corresponding cam crown extending from the support base. After filling/refilling tank with water, the user hooks it under tightly sealed conditions by loading said tank with its bottom under axial rotational movements preventing engagement on the plate and then rotating it axially, by using the handle it is provided with. Dragged in this movement by the engagement constraint, the plate will move upwards, by being so pushed by the coupled cams, bringing with itself and causing the tank to move upwards until said tank gets compressed, statically blocked with its filling/refilling mouth against the tightly sealing gasket, installed on the inner top portion of the chamber.

According to another embodiment, the fixedly fastened tank consists of a container structure provided with a water filling/refilling mouth provided with an access and tightly sealing elements. Such a tank is mounted functionally fixed and tightly sealed against the sealing gasket installed in the inner top portion of the housing chamber provided inside the support means.

As already mentioned, according to the particular embodiment of the device, the water pressurization inside the tank can be obtained by means of a hand-operated pump or a motor-driven pump driven by a motor electrically connected with the mains, or power fed from electrical accumulators.

In the first case, said task of water pressurizing is committed to the hand actuation of a lever protruding from the support means, with said lever protruding to such an extent and being so positioned as to make extremely easy and comfortable the required movements to be performed by the user sitting on the toilet. The lever, hinged onto a pivot inside the support means acts on the piston of the pump and the obtained pressure is controlled by a pressure control means.

In the second case, if the pump, installed inside the support, is driven by an electrical motor power fed from the mains, there will be a cable with a suitable connector which functionally comes out from the support. If, on the contrary, the electrical power is supplied by electrical accumulators, the support means will be provided with a suitable housing chamber in order to functionally house the accumulators.

In both said electrical motor driven embodiments, the initial pump starting up is controlled by the user acting on a switch installed on the external body of the support, whereas the electrical motor stopping and starting up will be controlled by a pressure switch so regulated as to open the electrical circuit (i.e., stop the electrical motor) when the pressure of overhead air reaches the established value, and to close the circuit again (i.e., start up again the electrical motor when this pressure value approaches the low limit of the pressure range necessary for the production of effective water jets.

The electrical motor driven complementary cleansing device for toilet bowls can be indefinitely left in the above disclosed situation, i.e., connected with the mains and with the switch keeping the circuit closed, because, as the whole device is tightly sealed, the electrical motor and consequently the pump will stop acting as soon as the operating pressure is reached and will remain in such a condition (i.e., inactive) until another use of water jets is required; only then, the intervention of the pressure switch will cause them to start again and will cause them to stop as soon as the optimal pressure value is reached again, with this cycle being repeated indefinitely.

Obviously, if the user so desires, the electrical circuit can be disabled by acting on the switch after each used; this will not cause the residual pressure inside the tank to get lost; on the contrary such a residual pressure inside the tank will cause the electrical motor operating time to be shorter when the user will act once more on the switch in order to start up the motor again.

The portable water jet launching body, which can be comfortably hold by the user with his hand, and can be oriented at will nearby the support means contains the water jet launching and interrupting device and a jet regulating nozzle. It consists of a light-weight, easily handled, nozzle, constituted by two half-bodies hinged onto each other in a "nut-cracker" fashion, and can be elastically and limitedly moved away from, and towards each other, and the chamber defined by them contains the water jets opening and closing valve, which can be actuated by the operator by him simply pressing the nozzle in his hand, thus causing the half-bodies to move towards each other until they reach their stroke limit. The water jet launching body ends at it front side with the water jets diffusing nozzle, and at its rear side with the flexible, extensible hose extending from the fitting which puts it into connection with the dipleg.

The support means consists of a first internal structure which, only for the sake of disclosure simplification, we will define as being constituted by a cylinder closed at both ends and having, on a side of it, a wide passage which constitutes the tank entering and housing chamber. In the particular embodiment with the removable tank, from the inner side of the cylinder base a pin protrudes centrally and, diametrically around this, a cam crown extends. A plate having on its bottom face a corresponding cam crown to the first one and on its upper side a "U" shape hollow, is rotatably coupled with the pin, functionally resting with its cam crown on the cam crown extending from the base.

On the inner top surface of the cylinder a ring-shaped tightly sealing gasket is installed and inside the area defined by this ring, the following elements are provided: the fitting for connecting the flexible dipleg for water intake, the duct atmospherically communicating with the pressure switch and the non-return valve for air coming from the pump. On the upper side, the following elements are installed: the fitting for connecting the pipe for pressurized water flow, the pressure switch and the hand-operated or electrical motor-driven pump for pressurizing air feeding. The disclosed structure and the relevant elements are contained inside a second external structure performing both the tasks of aesthetical shell and functional assembly for the other elements as: base, plate, table, hand-operated lever, switch, energy accumulator, and so forth, besides serving, at its end top, as a chamber for orderly receiving and housing the turns of the hose coil leading pressurized water to the nozzle, as wells as, with its upper opening, as functional resting means for the water jet launching body.

The embodiment provided with the fixedly fastened tank is different from the above disclosed embodiment because it is provided with a system for fixedly fastening the tank, obtained by means of a screw-thread borne by a collar extending from the internal top portion of the support, or a bayonet coupling, and because the system of the plate with pushing cams is not provided.

In practical use, the user, after filling the tank with water and fastening it to the support under tightly sealed conditions and will actuate the pump, thus compressing the overhead air above the water inside the tank, until the cleansing device operating pressure is reached.

Under these conditions, the pressurized air bubble forces water to flow from the tank into the dipleg, then, from here, to flow upwards along the hose coil leading to the closing/opening valve installed inside the water jet launching body.

Then, the user, after grasping in his hand and taking up the water jet launching body from its elastic rest position, will be free to orient it thanks to the extensibility of the hose coil, aiming, from distance, at the material to be removed from the bowl and then will act on the opening valve in order to launch against said material as many water jets as needed in order to remove it.

The so conceived invention can be supplied with modifications and changes, all falling within the scope of the inventive concept.

Furthermore, all details can be replaced by other technically equivalent elements.

In practice, the used materials, provided they are compatible with the specific use envisaged, as well as have the dimensions and the shapes as necessary for the invention, can be whichever, according to the requirements.

Although a preferred embodiment of the invention has been specifically illustrated and described herein, it is to be understood that minor variations may be made in the apparatus without departing from the spirit and scope of the invention, as defined the appended claims.

I claim:

1. A complementary cleanser device for toilet bowls comprising a support, a tank adapted to be filled and refilled with water, means for securing said tank to said support, means for pressurizing water in said tank, valve means for controlling the pressure within said tank, a water spray nozzle in fluid communication with said tank by means of a hose, said support including means for supporting said nozzle, said tank having a filling mouth, gasket means for creating a seal between said support and said tank substantially at the filling mouth thereof, and cooperative cam means between said support and said tank operative upon tank rotation to compress said gasket means and create the seal between said support and tank.

2. The complementary cleanser device as defined in claim 1 wherein said nozzle includes a pair of nozzle bodies, means for hinging said nozzle bodies to each other, and means for normally biasing said nozzle bodies away from each other.

3. The complementary cleanser device as defined in claim 2 wherein said support includes an upper opening, and said nozzle includes a lower end portion contoured for reception into said upper opening.

4. The complementary cleanser device as defined in claim 2 wherein said nozzle includes a pair of nozzle bodies having upper and lower end portions, means for hinging said nozzle bodies to each other, said support includes an upper opening, and said nozzle body lower end portions being contoured for reception into said upper opening.

5. The complementary cleanser device as defined in claim 2 wherein said support includes an upper end portion defining a chamber, and said hose includes a plurality of coils which are normally housed in said chamber.

6. The complementary cleanser device as defined in claim 2 including pump means for pressurizing the interior of said tank.

7. The complementary cleanser device as defined in claim 1 wherein said nozzle includes a pair of nozzle bodies, means for hinging said nozzle bodies to each other, means for normally biasing said nozzle bodies away from each other, said biasing means housing said valve means, and said valve means being operative upon relative hinging movement between said nozzles.

8. The complementary cleanser device as defined in claim 7 wherein said support includes an upper opening, and said nozzle includes a lower end portion contoured for reception into said upper opening.

9. The complementary cleanser device as defined in claim 7 wherein said nozzle includes a pair of nozzle bodies having upper and lower end portions, means for hinging said nozzle bodies to each other, said support includes an upper opening, and said nozzle body lower end portions being contoured for reception into said upper opening.

10. The complementary cleanser device as defined in claim 7 wherein said support includes an upper end portion defining a chamber, and said hose includes a plurality of coils which are normally housed in said chamber.

11. The complementary cleanser device as defined in claim 7 including pump means for pressurizing the interior of said tank.

12. The complementary cleanser device as defined in claim 1 wherein said nozzle includes a pair of nozzle bodies, means for hinging said nozzle bodies to each other, means for normally biasing said nozzle bodies away from each other, said biasing means housing said valve means, said valve means being operative upon relative hinging movement between said nozzles, and said biasing means includes a spring for normally biasing said nozzle bodies away from each other and closing said valve means.

13. The complementary cleanser device as defined in claim 12 wherein said support includes an upper opening, and said nozzle includes a lower end portion contoured for reception into said upper opening.

14. The complementary cleanser device as defined in claim 12 wherein said nozzle includes a pair of nozzle bodies having upper and lower end portions, means for hinging said nozzle bodies to each other, said support includes an upper opening, and said nozzle body lower end portions being contoured for reception into said upper opening.

15. The complementary cleanser device as defined in claim 12 wherein said support includes an upper end portion defining a chamber, and said hose includes a plurality of coils which are normally housed in said chamber.

16. The complementary cleanser device as defined in claim 12 including pump means for pressurizing the interior of said tank.

17. The complementary cleanser device as defined in claim 1 wherein said nozzle includes a pair of nozzle bodies, means for hinging said nozzle bodies to each other, means for normally biasing said nozzle bodies away from each other, said biasing means housing said valve means, said valve means being operative upon relative hinging movement between said nozzles, said biasing means includes a spring for normally biasing said nozzle bodies away from each other and closing said valve means, and said valve means includes a spool valve.

18. The complementary cleanser device as defined in claim 17 wherein said support includes an upper opening, and said nozzle includes a lower end portion contoured for reception into said upper opening.

19. The complementary cleanser device as defined in claim 17 wherein said nozzle includes a pair of nozzle bodies having upper and lower end portions, means for hinging said nozzle bodies to each other, said support includes an upper opening, and said nozzle body lower end portions being contoured for reception into said upper opening.

20. The complementary cleanser device as defined in claim 17 wherein said support includes an upper end portion defining a chamber, and said hose includes a plurality of coils which are normally housed in said chamber.

21. The complementary cleanser device as defined in claim 17 including pump means for pressurizing the interior of said tank.

22. The complementary cleanser device as defined in claim 1 wherein said nozzle includes a pair of nozzle bodies, means for hinging said nozzle bodies to each other, means for normally biasing said nozzle bodies away from each other, said biasing means housing said valve means, said valve means being operative upon relative hinging movement between said nozzles, and said biasing means includes a spring for normally biasing said nozzle bodies away from each other and closing said valve means, said valve means includes a spool valve having a valve stem movable by hinging movement of one of said nozzle bodies.

23. The complementary cleanser device as defined in claim 1 wherein said support includes an upper opening, and said nozzle includes a lower end portion contoured for reception into said upper opening.

24. The complementary cleanser device as defined in claim 1 wherein said nozzle includes a pair of nozzle bodies having upper and lower end portions, means for hinging said nozzle bodies to each other, said support includes an upper opening, and said nozzle body lower end portions being contoured for reception into said upper opening.

25. The complementary cleanser device as defined in claim 1 wherein said support includes an upper end portion defining a chamber, and said hose includes a plurality of coils which are normally housed in said chamber.

26. The complementary cleanser device as defined in claim 1 including pump means for pressurizing the interior of said tank.

27. The complementary cleanser device as defined in claim 1 including hand-operated pump means for pressurizing the interior of said tank.

28. The complementary cleanser device as defined in claim 1 including electrically driven pump means for pressurizing the interior of said tank.

29. A complementary cleanser device for toilet bowls comprising a support, a tank adapted to be filled and refilled with water, means for securing said tank to said support, means for pressurizing water in said tank, valve means for controlling the pressure within said tank, a water spray nozzle in fluid communication with said tank by means of a hose, said nozzle includes a pair of nozzle bodies having upper and lower end portions, means for hinging said nozzle bodies to each other, means for normally biasing said nozzle bodies away from each other, said biasing means housing said valve means, said valve means being operative upon relative hinging movement between said nozzle bodies, said support includes an upper opening, said nozzle body lower end portions being contoured for reception into said upper opening, said support includes an upper end portion defining a chamber, and said hose includes a plurality of coils which are normally housed in said chamber.

30. The complementary cleanser device as defined in claim 29 wherein said biasing means includes a spring for normally biasing said nozzle bodies away from each other and closing said valve means.

31. The complementary cleanser device as defined in claim 29 wherein said biasing means includes a spring for normally biasing said nozzle bodies away from each other and closing said valve means, and said valve means includes a spool valve.

32. The complementary cleanser device as defined in claim 29 wherein said biasing means includes a spring for normally biasing said nozzle bodies away from each other and closing said valve means, and said valve means includes a spool valve having a valve stem movable by hinging movement of one of said nozzle bodies.

* * * * *